United States Patent [19]

Van Hattem et al.

[11] 4,415,445

[45] Nov. 15, 1983

[54] PROCESS FOR THE AGGLOMERATION OF SOLIDS

[75] Inventors: Arie Van Hattem; Johan A. Prommel; Augustinus W. M. Roes, all of Amsterdam, Netherlands

[73] Assignee: Shell Oil Company, Houston, Tex.

[21] Appl. No.: 371,105

[22] Filed: Apr. 23, 1982

[30] Foreign Application Priority Data

Aug. 6, 1981 [GB] United Kingdom ..... 8124112

[51] Int. Cl.[3] ..... B03B 1/00

[52] U.S. Cl. ..... 209/5; 209/49; 209/166; 44/24

[58] Field of Search ..... 209/5, 49, 166; 210/729, 730, 713; 44/24

[56] References Cited

U.S. PATENT DOCUMENTS

| | | | |
|---|---|---|---|
| 4,138,226 | 2/1979 | Verschuur | 44/24 |
| 4,248,697 | 2/1981 | Halvorsen | 209/5 |
| 4,311,488 | 1/1982 | Verschuur | 209/5 |
| 4,346,010 | 8/1982 | Ogino et al. | 209/5 |

*Primary Examiner*—Bernard Nozick

[57] ABSTRACT

Finely divided solids suspended in liquids (such as aqueous slurries of coal fines) are agglomerated by flowing those suspensions and a binding agent into a turbulent-flow agglomeration zone along with a slurry of seed pellets having sizes and proportions correlated with those of the finely divided solids and the agglomerates being formed to induce particle growth by layering rather than by coalescence.

4 Claims, 2 Drawing Figures

PROCESS FOR THE AGGLOMERATION OF SOLIDS

BACKGROUND OF THE INVENTION

The invention relates to a process for the agglomeration of solids, in particular of finely divided solids, suspended in a liquid.

Agglomeration is a well known process in separating solids from a carrier liquid and/or solid contaminating material. A typical example is the agglomeration of coal fines for facilitating the separation of said coal particles from water, used as a carrier liquid during the transportation by pipeline of the coal fines. Other examples are the agglomeration of coal fines for separating the coal from gangue, upgrading of coal fines for use in blast furnaces and enrichment of ores.

In general, agglomeration is carried out by bringing the solids suspended in a liquid into contact under conditions of turbulent flow with a binding agent. The binding agent is so chosen that it is capable of wetting the surface of the solids. The binding agent binds the solids together to form agglomerates, which can be easily separated from the liquid by mechanical means, such as a sieve. In case finely divided solids are to be separated from a liquid in which also solid-contaminating material is suspended, the binding agent is so chosen that it wets the surface of the solids to be separated preferentially over that of the solid contaminating material. In this manner only agglomerates of the concerned solids are formed, which can easily be separated from the remaining suspension of the solid contaminating material.

In the case of coal to be separated from gangue the solids are suspended in a finely divided form in water. This suspension is brought into contact under conditions of tubulent flow with an oily material such as fuel oil, bitumen, naptha, coal tar and the like. Such materials expel the water from the coal particles and not from the gangue. Depending on concentrations, binding agent and flow conditions, various types of agglomerates may be obtained, ranging from loosely fluffy material to hard pellets.

In the last years there is a tendency to carry out processes for the separation of solids from contaminating material on an ever increasing scale. Increasing amounts of domestic and industrial effluents, containing waste material become free in technologically advanced societies. These effluents, which tend to pollute water courses, land and the atmosphere, form a major hazard in an advanced society. For that reason effluent treatment processes to separate the waste material from effluents need to cope with these large amounts of effluent in order to produce clean potable water supplies to satisfy domestic and industrial requirements. Further, coal gets an ever increasing importance as an energy source in the nearest future. In the mining industry large amounts of coal fines contaminated with gangue and very often also with other contaminations, such as clay, are obtained. These coal fines should be separated from the contaminations and bound together to larger coal particles which are easy to handle.

Prior patents have suggested various uses of stepwise treatments for agglomerating slurries of finely divided solids. For example, British Pat. No. 1,388,371 suggests flowing a stream of the suspended fines and a binding agent through a particle-agglomerating zone of turbulent flow, screening-out the agglomerates having diameters exceeding 0.25 millimeters, grinding portions of the screened-out agglomerates to sizes of from 0.01 to 0.5 millimeters and recycling the ground particles to serve as nuclei for the agglomeration process. Such a procedure tends to promote particle growth by the coalescence machanism and is particularly useful for decreasing the amount of contaminating material being included in the agglomerates. British Pat. No. 1,390,827 suggests agglomerating such liquid-suspended fines with a binding agent in a zone of turbulent flow, separating the agglomerates, and then re-treating the agglomerates in contact with additional binding agent and a liquid containing less contaminating materials than the first-used liquid. This also tends to reduce the contamination of the agglomerates.

But, in order to cope with the ever increasing amounts of solids to be separated, it is important that the agglomeration processes should be less time consuming and should produce sufficiently large agglomerates for further handling, such as separation on a screen. A particular object of the present invention is to provide a relatively rapid process for agglomerating fine solids into relatively large and substantially uniform agglomerates.

SUMMARY OF THE INVENTION

According to the present invention a process for agglomerating finely divided solids suspended in a liquid comprises the following. The solids suspended in the liquid are passed through an agglomeration zone under conditions of turbulent flow together with a binding agent to form agglomerates. Seed pellets which are significantly larger than the finely divided solids are passed through the agglomeration zone as well. And, the ratio of the amount of seed pellets to the amount of finely divided solids in the agglomeration zone is kept substantially constant.

The seed pellets used in the present process are composed of material having a composition which is the same as, or similar to, that of the solids to be agglomerated and is suspended in a liquid which is the same as, or similar to, that containing the solids to be agglomerated. The solids and liquid are at least "similar" in consisting of the same material or a material which is so similar as to avoid any phase separation or chemical reaction with the liquids or solids being agglomerated.

The present invention is particularly applicable to a continuous process for treating an aqueous suspension of finely divided solids (e.g., having diameters of generally less than about 0.25 millimeters) to form relatively large agglomerates (e.g., having diameters in the order of 1 millimeter) by using seed pellets having diameters which are at least substantially all significantly larger than the particles being agglomerated but significantly smaller than the agglomerates being formed (e.g., having diameters of from about 0.5 to 1 millimeter) in proportions causing the size enlargement of the particles being agglomerated to involve growth by layering rather than by coalescence.

According to a suitable embodiment of the invention the seed pellets are formed by grinding part of the formed agglomerates. According to another suitable embodiment the seed pellets are formed by passing part of the solids suspended in the liquid through a pre-agglomeration zone prior to passing the solids through the agglomeration zone.

DESCRIPTION OF THE INVENTION

Figure 1:
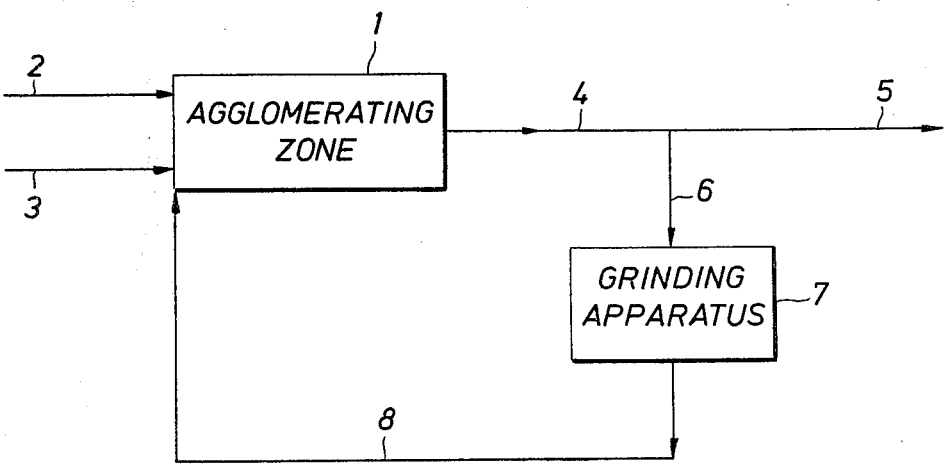
FIG. 1 shows a flow scheme of a first agglomeration process according to the invention.

In FIG. 1 a turbulent flow agglomerating zone has been indicated by reference numeral 1. This zone may be formed of any suitable means for imparting a turbulent flow to a solids-suspending, liquid stream. Examples of such means are a stirred vessel, a rotating-cylinder pelletizer or the like. A stream of a suspension 2 of finely divided solids to be agglomerated in a liquid and a stream of a binding agent 3 are passed to the agglomeration zone 1. The outgoing stream 4 contains agglomerates of the finely divided solids and liquid. The outgoing stream 4 of suspended agglomerates is split into streams 5 and 6, with stream 6 being passed to a grinding apparatus 7. A stream 8 of liquid-suspended ground agglomerates is recirculated to the agglomeration zone 1.

Figure 2:
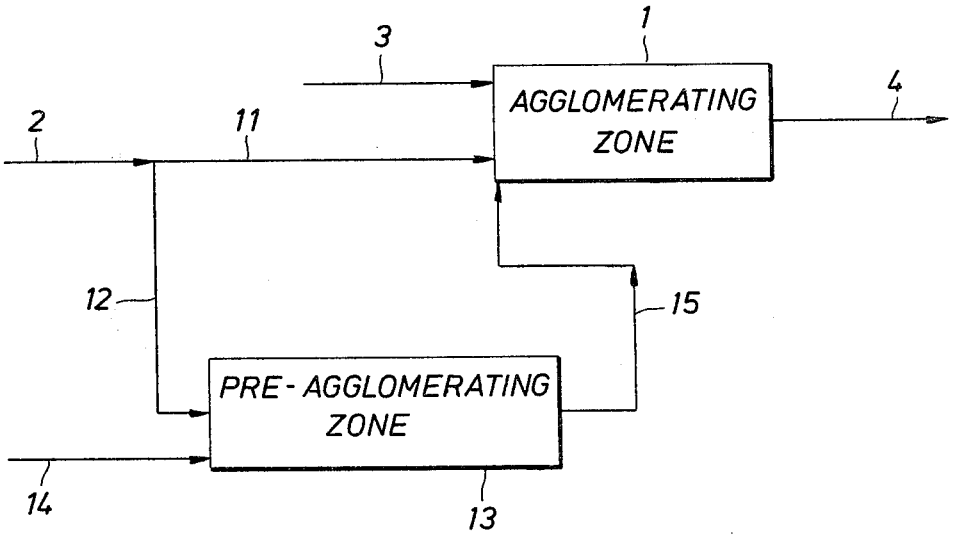
FIG. 2 shows a flow scheme of a second agglomeration process according to the invention.

In FIG. 2 the numbers denoting elements of the scheme that have been used earlier have the same meaning as before. The stream 2 of finely divided solids to be agglomerated, suspended in a liquid is split into two streams 11 and 12. Stream 11 is sent directly to the agglomeration zone 1. The stream 12 is passed through a pre-agglomerating zone 13, which may be a device of the same type as used in the agglomeration zone 1. A stream 14 of binding agent is introduced into the pre-agglomeration zone 13. The stream 15 of preformed agglomerates from the pre-agglomeration zone 13 is introduced into the agglomeration zone 1 together with the stream 11 of finely divided solids suspended in aqueous liquid.

The ground material in the flow scheme shown in FIG. 1 and the agglomerates formed in the pre-agglomeration zone 13 shown in FIG. 2 have a particle size exceeding 0.5 millimeters to ensure that they act as seed pellets in the agglomeration zone 1, as will be explained hereinafter in more detail. Preferably, the ground material and the agglomerates from the pre-agglomeration zone 13 have a particle size between 0.5 and 1 millimeter.

The phenomenon of agglomeration occurring in the agglomeration zone 1 and the pre-agglomeration zone 13 will now be further explained. Agglomeration may be defined as size enlargement by interparticle bonding. The three most important growth mechanisms occurring in agglomeration are nucleation, coalescence and layering (also called snowballing).

Nucleation is the formation of new small agglomerates by the agglomeration of finely divided solids wetted by a binding agent. These small agglomerates or pellets can grow further by one of the other two mechanisms.

Coalescence refers to the growth of agglomerates as a result of the clumping together of two or more agglomerates.

Layering is the growth mechanism wherein finely divided solids stick onto the surface of already formed agglomerates.

Let us assume that a suspension of finely divided solids in liquid is passed through an agglomeration zone under conditions of turbulent flow together with a binding agent capable of wetting the solids. Agglomeration first takes place by the mechanism of nucleation and subsequently proceeds by the mechanism of coalescence. In the nucleation phase fine solids adhere to droplets of the binding agent, thereby enwrapping said droplets. Subsequently, the fine solids penetrate into the droplets so that micro-agglomerates (of fine solids wetted by binding agent) are formed. When the amount of binding agent is sufficient, the micro-agglomerates grow further by coalescence.

As presently understood, it appears that pellet growth by layering is impossible where there is no backmixing of agglomerates to the inlet region of the agglomeration zone. The pellet growth rate by coalescence is defined as a coalescence rate constant, $K_c$, the increase in pellet radius r per unit time t. Thus, $K_c = dr/dt$.

Tests have been carried out to investigate the dependency of the coalescence rate constant $K_c$ on the rate of turbulence of a suspension of solids being agglomerated. In these tests a suspension of solids in liquid was brought into contact with a binding agent in a stirring vessel under conditions of turbulent flow.

Table 1 shows the coalescence rate constant for a number of stirring speeds.

TABLE 1

COALESCENSING TEST RESULTS

| Test No. | Stirrer speed, rev/min | Average power dissipation $\bar{\epsilon}'$, W/kg | Coalescense rate constant $k_c$, $10^{-8}$ m/s |
|---|---|---|---|
| 1 | 2020 | 24.0 | 2.7 |
| 2 | 1840 | 18.1 | 2.3 |
| 3 | 1670 | 13.5 | 2.0 |
| 4 | 1460 | 9.0 | 2.7 |
| 5 | 1350 | 7.1 | 1.5 |
| 6 | 1100 | 12.1 | 0.7 |
| 7 | 950 | 7.8 | 1.2 |
| 8 | 850 | 5.6 | 1.1 |
| 9 | 650 | 2.5 | 0.8 |

From this table it appears that, depending on the stirring speed, the coalescence rate constant varies from about $0.7 \times 10^{-8}$ m/sec to about $2.7 \times 10^{-8}$ m/sec.

Measurements were made of the layering rate constant, i.e., the growth rate at which pellets grow by the layering mechanism. An aqueous suspension of finely divided solids having a particle size below 0.25 millimeters was turbulently agitated in contact with a binding agent. Agglomerates having a particle size exceeding 0.5 millimeters were introduced along with the finely divided solids.

TABLE 2

LAYERING TEST RESULTS

| Test No. | $\bar{\epsilon}'$, W/kg | Layering rate constant $10^{-7}$ m/s |
|---|---|---|
| 1 | 4.6 | 1.1 |
| 2 | 6.8 | 1.3 |
| 3 | 10.2 | 1.5 |
| 4 | 13.3 | 1.8 |
| 5 | 13.3 | 1.8 |
| 6 | 17.6 | 1.9 |
| 7 | 6.8 | 1.3 |
| 8 | 10.4 | 1.6 |
| 9 | 13.6 | 1.7 |
| 10 | 17.6 | 1.8 |

$\bar{\epsilon}'$: average power input

Table 2 indicates the layering rate constant for a number of different power inputs. Depending on the power inputs, the layering rate constant varies from $1.1\times10^{-7}$ to $1.9\times10^{-7}$ m/sec.

In both the coalescence tests and the layering tests the amount of binding agent supplied was 16% by weight of the suspension of solids in liquid. The measurements show that although the power inputs in the coalescence tests were higher than those in the layering tests, pellet growth by layering takes place about 10 times faster than pellet growth by coalescence of agglomerates.

In addition, it was found that, during the layering tests, no new agglomerates were formed. This means that a continuous layering process can only be stable when continuously new seed pellets are added.

According to the invention agglomerates, also called seed pellets are added to the agglomeration zone 1, at a rate which causes a layering of the finely divided solids suspended in a liquid on the agglomerates. By this procedure agglomerates are formed very quickly so that, per time unit, a high throughput can be obtained, compared with the throughput obtainable when the finely divided solids are agglomerated without the introduction of the above-mentioned seed pellets. It has been found that the seed pellets or agglomerates should have a particle size exceeding 0.5 millimeters in order to cause the layering of finely divided solids, such as particles having a size below 250 μm, on the seed pellets.

The maximum size of the seed pellets depends on the growth in the nucleation. Preferably, the maximum size is about 1 millimeter being the size of seed pellets fully formed by the nucleation mechanism.

The amount of seed pellets to be added to a suspension of finely divided solids in liquid is preferably between about 10 and 30 percent by weight of the finely divided solids. The amount of seed pellets added should be enough to ensure a growth of the seed pellets by layering of the finely divided solids on said pellets without the risk of an uncontrolled clumping together of the finely divided solids. It has been found that a suitable amount of seed pellets is in the range of 10–30% by weight of the finely divided solids.

When the concentration of seed pellets is within this range, substantially all the finely divided solids are layered on the surfaces of the seed pellets. To assure that substantially all of the finely divided solids are layered on the surfaces of the seed pellets, the rates of the inflows of finely divided solids and seed pellets should be correlated so the number of pellets in the agglomeration zone is kept substantially constant.

In the process shown in FIG. 1, the stream of agglomerates and liquid from the agglomeration zone 1, may be first led over a screen to separate the agglomerates from the liquid, prior to leading part of the agglomerates through the grinding apparatus 7. To facilitate the transport of ground agglomerates from the grinding apparatus to the agglomeration zone 1 some fresh liquid may be added to the ground agglomerates.

In the process shown in FIG. 2, the seed pellets formed in the pre-agglomeration zone 13 may be screened to remove nonagglomerated solids before being fed into the agglomeration zone 1.

In this embodiment, in order to obtain an amount of seed pellets in the range of 10–30% by weight of the finely divided solids in the stream 1, 10–30% of stream 1 can be passed through the pre-agglomeration zone 13.

It is noted that in either embodiment, the outgoing stream 4 of agglomerates and liquid may be further treated by passing the stream through a separating zone, for example formed by a sieve, to separate the agglomerates from the liquid.

Further, it is noted that the liquid in which the finely divided solids to be agglomerated are suspended may contain other contaminating material, in the form of solids. In this case, the binding agent should be so chosen that the binding agent preferentially wets the surface of the solids to be agglomerated. For example, where the solids to be agglomerated are coal fines suspended in an aqueous liquid, the binding agent is preferably an oil, which may be emulsified with an aqueous liquid.

What is claimed is:

1. A process for agglomerating finely divided coal particles suspended in aqueous liquid comprising:

flowing substantially continuous streams of an aqueous liquid suspension of fine coal particles having diameters less than 0.25 mm and an oily binder material into an agglomerating zone maintained under turkulant flow and concurrently continuously flowing into the agglomerating zone an aqueous liquid suspension of seed particles consisting essentially of coal or coal agglomerates having diameters which are substantially all between about 0.5 and 1 mm so that the proportion of the seed pellets within the agglomerating zone is maintained at about 10 to 30% of the solid particles within that zone and the agglomeration of the fine coal particles accomplished by layering rather than by coalescence.

2. The process of claim 1 in which the seed pellets are formed by grinding, screening and recycling a portion of the agglomerates being formed.

3. The process of claim 1 in which the seed pellets are formed by a pre-agglomeration and screening of the finely divided solids.

4. The process of claim 3 in which the stream of finely divided solids is split, with a portion containing from about 10 to 30% of the solids being subjected to the pre-agglomeration.

* * * * *